US006925730B2

(12) United States Patent
Arpke

(10) Patent No.: US 6,925,730 B2
(45) Date of Patent: Aug. 9, 2005

(54) APPARATUS FOR REMOVING PAINT

(76) Inventor: Robert C. Arpke, 5102 Colorando St., Duluth, MN (US) 55804

( * ) Notice: Subject to any disclaimer, the term of this patent is extended or adjusted under 35 U.S.C. 154(b) by 0 days.

(21) Appl. No.: 10/756,559

(22) Filed: Jan. 13, 2004

(65) Prior Publication Data

US 2005/0150127 A1 Jul. 14, 2005

(51) Int. Cl.[7] ..... F26B 25/06; F17C 7/02
(52) U.S. Cl. ..... 34/229; 34/230; 62/52.1
(58) Field of Search ..... 137/597; 34/288, 34/359, 360, 362, 413, 541, 585, 83, 191, 34/229, 230; 62/52.1; 451/53

(56) References Cited

U.S. PATENT DOCUMENTS 1,382,640 A * 6/1921 Heinrich ..... 239/415
2,699,403 A * 1/1955 Courts ..... 427/299
3,937,253 A * 2/1976 Lilja ..... 137/625.18
4,120,810 A 10/1978 Palmer
4,312,156 A 1/1982 McWhorter
4,554,025 A 11/1985 Burke et al.
4,948,042 A * 8/1990 Tench et al. ..... 239/113
5,030,290 A 7/1991 Davis
5,044,129 A 9/1991 Olevitch
5,415,584 A * 5/1995 Brooke et al. ..... 451/99
5,456,085 A 10/1995 Popp et al.
5,931,721 A 8/1999 Rose et al.
6,358,907 B1 3/2002 Vitomir

* cited by examiner

*Primary Examiner*—Kenneth Rinehart
(74) *Attorney, Agent, or Firm*—Dale J. Ream

(57) ABSTRACT

A paint removal apparatus includes a canister partially filled with a pressurized coolant. The apparatus includes a housing having a body portion mounted atop the canister with a handle portion extending from the body portion. The handle includes an inlet port while the body portion includes first and second outlet ports. The inlet port is capable of connection to a compressed air stream for delivery thereof through an air channel between the inlet and second outlet ports. A coolant channel extends between the canister and the first outlet port. A trigger connected to a primary valve is movable between first, second, and third configurations. The primary valve and cooperating linkages enable a user to select between delivery of the air stream alone or a portion of the coolant whereby to strip paint. A scraping blade may be removably and rotatably coupled to the housing. The coolant may be dry ice.

18 Claims, 8 Drawing Sheets

APPARATUS FOR REMOVING PAINT

BACKGROUND OF THE INVENTION

The present invention relates generally to paint stripping devices and, more particularly, to an apparatus for stripping paint by selectively actuating compressed air and pressurized coolant.

Removal of paint from a surface such as wood is desirable prior to applying a fresh coat of paint so that the paint will remain adhered to the surface for a longer time period. Paint stripping has traditionally been a very slow process using harsh chemicals or sand blasting.

Various devices for removing paint, including cold stripping, have been proposed in the art. Although assumably effective for their intended purposes, the existing products and proposals do not provide efficient and selective delivery of a pressurized coolant and high velocity compressed air to remove paint by thermal shock.

Therefore, it is desirable to have a paint stripping apparatus for selectively delivering a highly pressurized coolant or compressed air stream for stripping paint from a surface by thermal shock. Further, it is desirable to have a paint stripping apparatus having a scraping blade that can be selectively configured adjacent the compressed air stream or coolant outlet nozzles.

SUMMARY OF THE INVENTION

An apparatus for removing paint from a surface according to the present invention includes a canister that is at least partially filled with a coolant under pressure. This coolant may be an aerosol propellant with a chemical product. When actuated, the chemical droplets are deposited on a surface and the propellant evaporates in a heat-removing endothermic reaction that results in a very low temperature that causes the paint to crack. The apparatus may be connected to an air compressor and includes an air channel such that a compressed air stream may be exerted upon the thermally shocked paint surface. This results in further cracking, flaking, and removal of the paint surface. A rotatable and removable blade may also be manipulated on the apparatus to further remove residual paint.

The coolant may alternately be solid carbon dioxide (dry ice) that is quickly transformed into a gaseous state for being exhausted from the canister at high pressure. Again, the high pressure exertion of an extremely cold stream thermally shocks a painted surface and causes it to crack or degrade. Subsequent exertion of a high energy air stream further results in paint removal. The canister is a heat exchanger in the dry ice embodiment.

Therefore, a general object of this invention is to provide an apparatus for stripping paint from a painted surface.

Another object is to provide a paint stripping apparatus, as aforesaid, having a container of high pressure coolant and a housing connectable to a compressed air source.

Still another object is to provide a paint stripping apparatus, as aforesaid, having a primary valve for selectively delivering either a portion of the coolant or a high pressure air stream through respective outlet ports.

Yet another object is to provide a paint stripping apparatus, as aforesaid, having removable nozzles for dispensing the coolant or compressed air in desired spray patterns.

A further object is to provide a paint stripping apparatus, as aforesaid, in which the canister is a heat exchanger and the coolant is solid dry ice transformable into a high pressure gaseous state.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

An apparatus for removing paint according to the following invention will now be described in detail with reference to FIGS. 1 through 8*d* of the accompanying drawings.

An apparatus 10 according to one embodiment of the present invention is shown in FIGS. 1 through 4*d* and includes a canister 12 that is at least partially filled with a coolant that will be selectively utilized to thermally shock a painted surface, as will be further described later. Preferably, the coolant is in an aerosol form including a liquid or gas propellant under high pressure and a chemical product. Upon actuation, the propellant may be dispensed as a spray with small particles or as foam or gel depending on the type of actuator valve 16 used. A suitable propellant would be liquid petroleum gas (LP gas) although other propellants such as dimethyl ether or HFC134a would also work. When the propellant spray hits a painted surface, the propellant evaporates at room temperature. This evaporation is an endothermic reaction which removes heat from the surface. It is possible achieve a surface temperature of −40° F. to −60° F. with such an endothermic reaction. Such a reaction causes a thermal shock and weakening of the painted surface.

Figure 1:
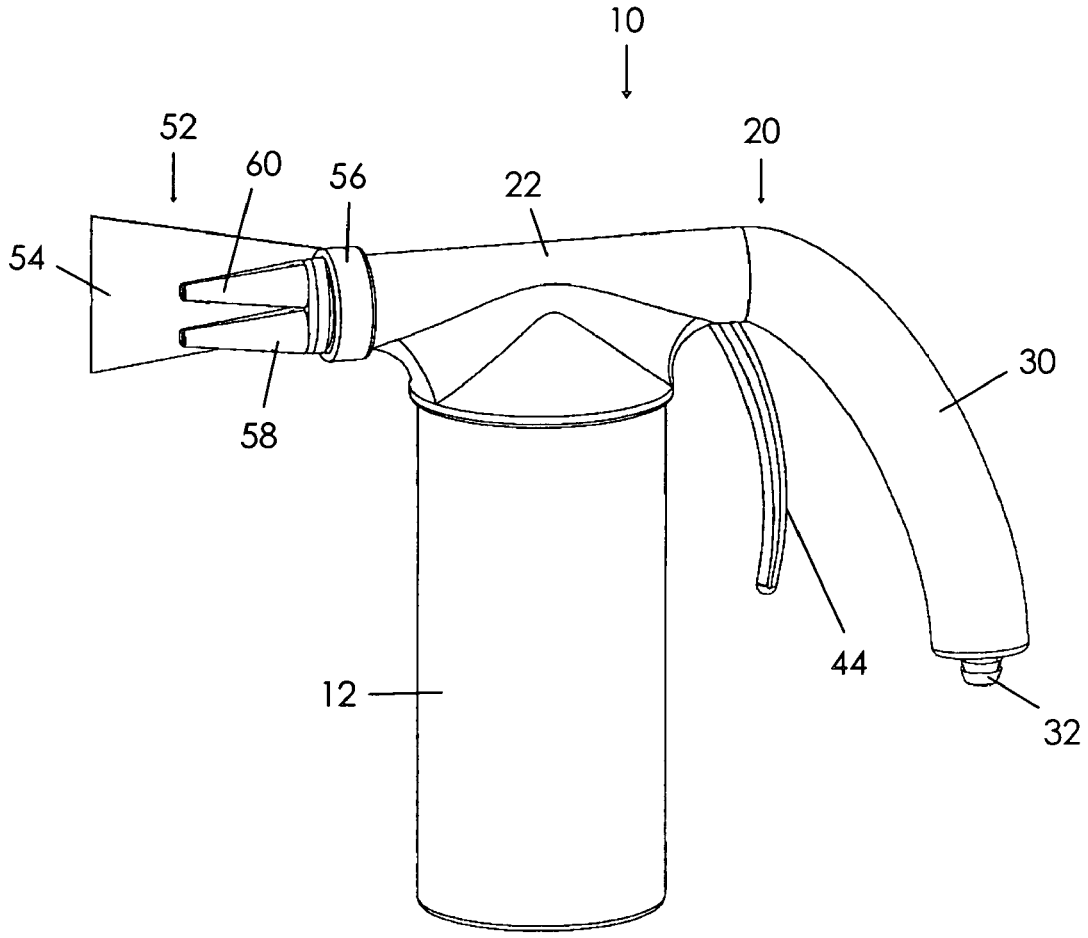
FIG. 1 is a perspective view of an apparatus for stripping paint according to one embodiment of the present invention.
Figure 2A:
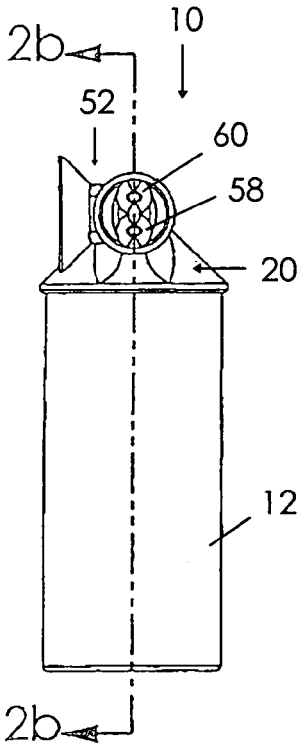
FIG. 2*a* is a front view of the apparatus as in FIG. 1.
Figure 2B:
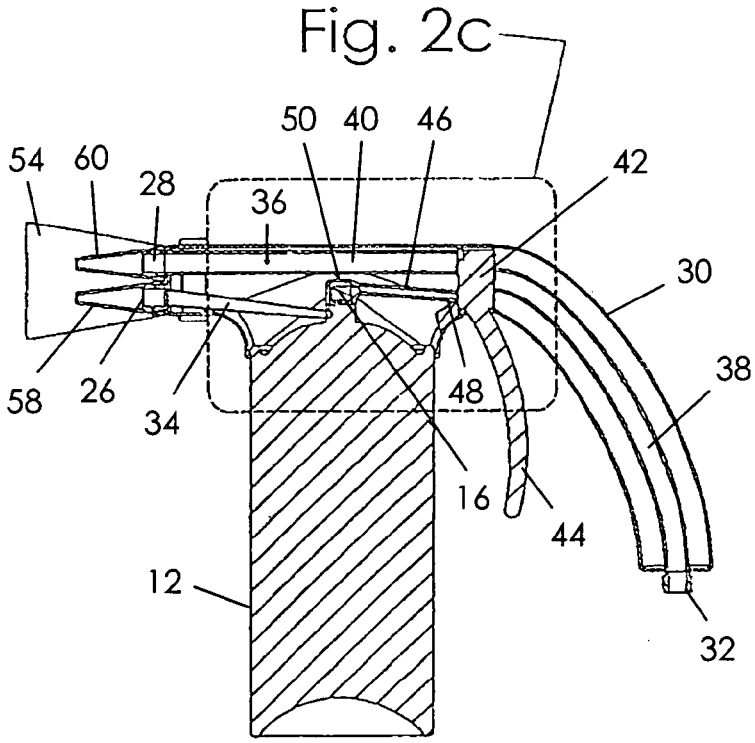
FIG. 2*b* is a sectional view taken along line 2*b*—2*b* of FIG. 2*a*, shown when the trigger is at a first configuration.
Figure 2C:
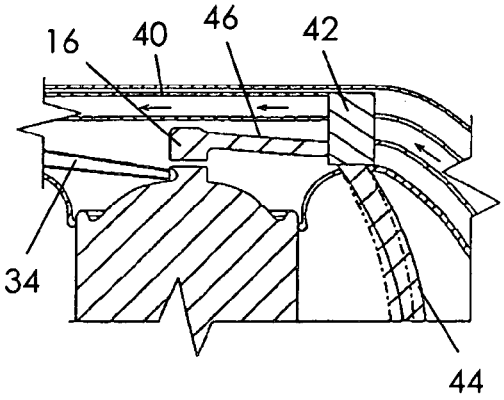
FIG. 2*c* is a sectional view taken from FIG. 2*b*, shown when the trigger is at a second configuration and shown with hidden lines depicting the apparatus when the trigger is at the first configuration.
Figure 2D:
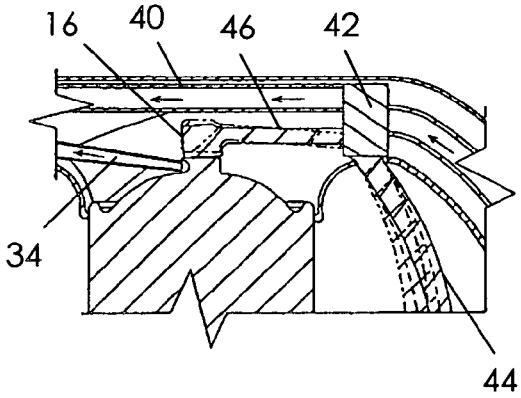
FIG. 2*d* is a sectional view as in FIG. 2*c*, shown when the trigger is at a third configuration and shown with hidden lines depicting the apparatus when the trigger is at the first and second configurations.

The apparatus 10 further includes a housing 20 having a body portion 22 and a handle portion 30 depending from a rear end of the body portion 22 (FIG. 1). The body portion 22 is configured to be mounted atop the canister 12. In other words, the body portion 22 may present a circular or dome-shaped configuration for being mounted atop a generally cylindrical canister (FIG. 3) although other complementary configurations would also work. The housing 20 defines a generally open interior space for holding other components as will be further described below. The handle portion 30 also includes a generally hollow interior space. A forward/front end 24 of the body portion 22 defines first 26 and second 28 outlet ports.

A coolant channel 34 is positioned within the interior space of the housing 20 and extends between an actuator valve 16 on the top 14 of the canister 12 and the first outlet port 26. The coolant channel 34 includes a tubular configuration constructed from a semi-flexible material conduit although a metal or other more rigid material would also work. Therefore, a portion of the canister high pressure coolant may be discharged through the coolant channel 34 and through the first outlet port 26 when the actuator valve 16 is depressed or otherwise actuated, so as to be deposited on a painted surface.

Similarly, an air channel 36 is positioned within the housing 20 and extends between the second outlet port 28 and an air inlet port 32 situated at a free end of the handle portion 30 (FIG. 2). The inlet port 32 is capable of being coupled to an air compressor or other source of pressurized or compressed air. Therefore, a stream of compressed air may be delivered through the air channel 36 and exhausted through the second outlet port 28.

The apparatus 10 includes means for selectively delivering either the coolant stream or the air stream. More particularly, a primary valve 42 is positioned within the body portion 22 of the housing 20 for regulating whether a coolant stream or compressed air stream is delivered to appropriate outlet ports. A trigger 44 is connected to the primary valve 42 and extends downwardly from the housing 20 for user manipulation thereof. Consequently, movement of the trigger 44 selectively moves the primary valve 42 between first, second, and third configurations, the first configuration configuring the primary valve 42 to prevent any stream from being discharged. Further exertion on the trigger moves the primary valve 42 to the second configuration for actuating a coolant stream, as will be described more fully below. Still further exertion on the handle_moves the primary valve 42 to the third configuration for allowing a compressed air stream to flow through the air channel 36, as will also be described below. Based on the corresponding interrelationship between the trigger 44 and primary valve 42, it should be appreciated that the position of both components may be interchangeably referred to as being in first, second, or third configurations.

Now with particular reference to actuating a coolant stream, an actuator arm 46 may be situated in the body portion 22 of the housing 20 having a proximal end 48 coupled directly to the primary valve 42 and a distal end 50 adjacent the canister actuator valve 16. This linkage is configured such that the actuator valve 16 is activated to release coolant when the trigger 44 and primary valve 42 are cooperatively moved to the second configuration.

It should be appreciated that the actuator arm 46 described above may be a hollow conduit such that the compressed air stream flowing through the air channel 36 may be diverted by the primary valve 42 to bear against and activate the actuator valve 16 when the primary valve 42 is at the second configuration. This would provide a pneumatic actuation.

When urged to its third configuration, the primary valve 42 allows the compressed air stream entering through the air inlet port 32 to flow through the primary valve and be exhausted through the second outlet port 28. It is understood, therefore, that the primary valve 42 separates the air channel 36 into an upstream portion 38 in the handle portion 30 and a downstream portion 40 in the body portion 22.

Figure 3:
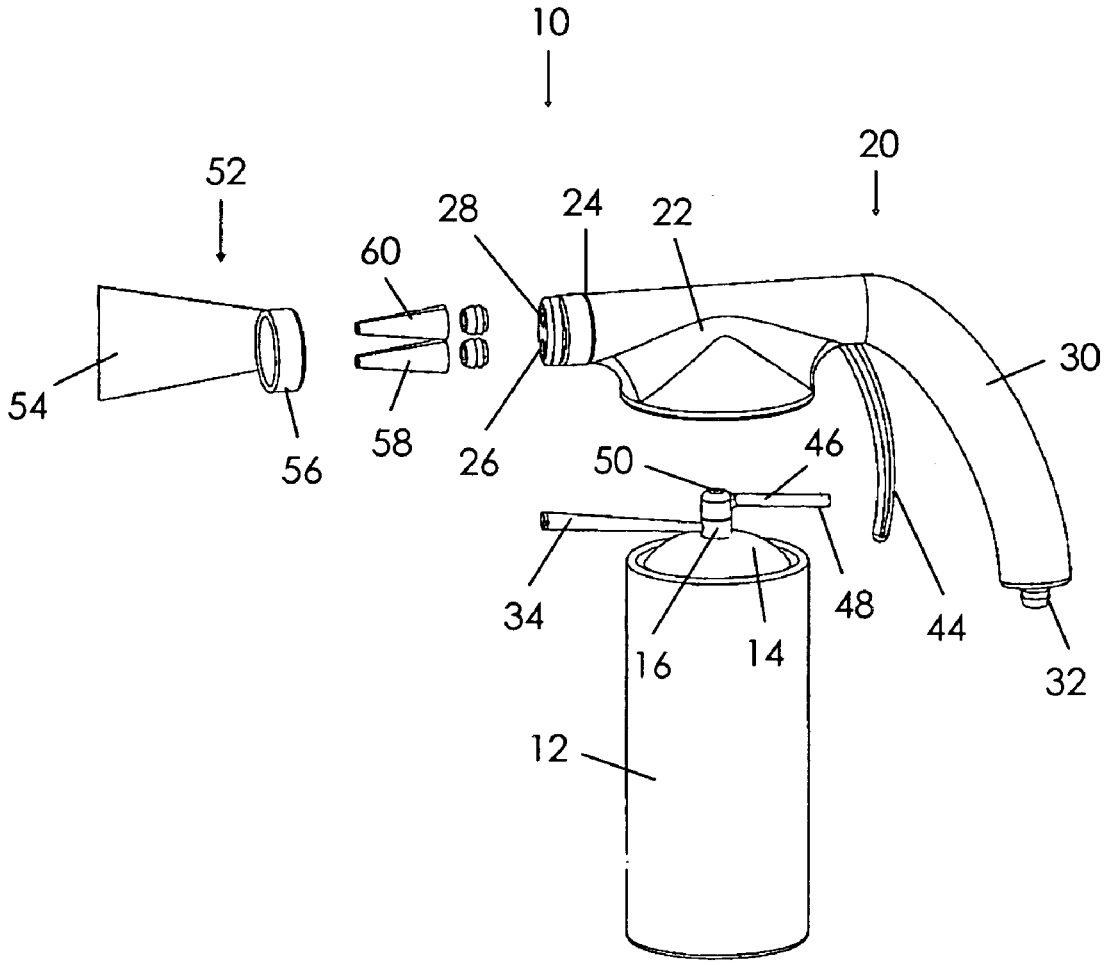
FIG. 3 is an exploded view of the apparatus as in FIG. 1.

Further, the paint removing apparatus 10 includes a scraping blade assembly 52 coupled to the forward end 24 of the body portion 22 (FIG. 3). Preferably, the scraping blade assembly 52 is coupled to the body portion 22 with a blade holder 56 mounted with a circular boss such that the blade may be rotated to a desired orientation for scraping paint (FIGS. 4*a*–4*d*). The forward end 24 of the body portion 22, therefore, preferably presents a circular or cylindrical configuration to accommodate this rotatability. An individual blade 54 may be removed from the blade holder 56 (or the entire scraping blade assembly removed altogether) and replaced when worn or when a blade having a different contour or configuration for the type or amount of paint being stripped is desired.

Figure 4A:
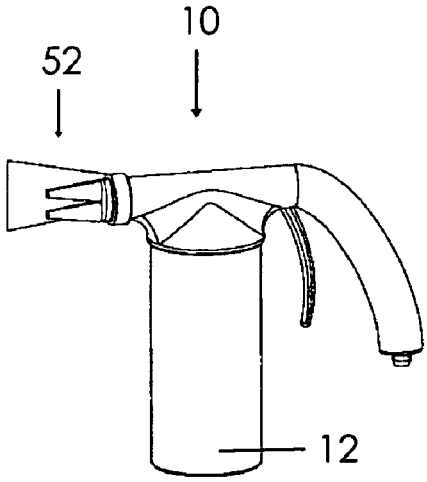
FIGS. 4*a*–4*d* are perspective views of the apparatus as in FIG. 1 showing a scraping blade in various configurations.
Figure 4C:
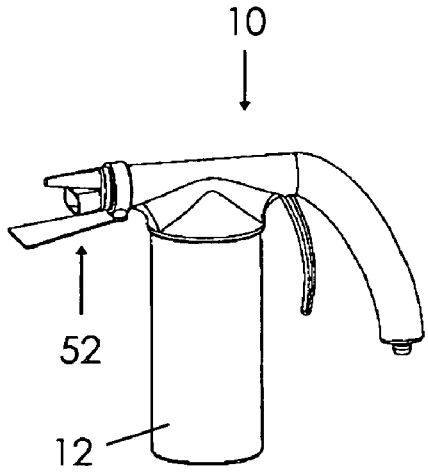
Figure 4B:
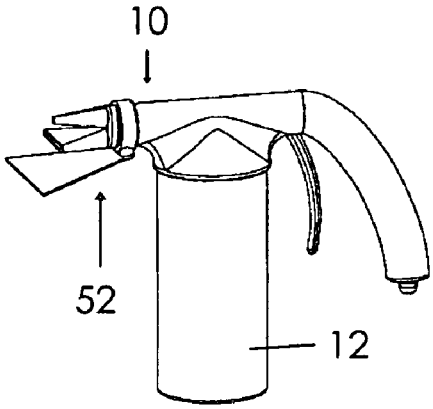
Figure 4D:
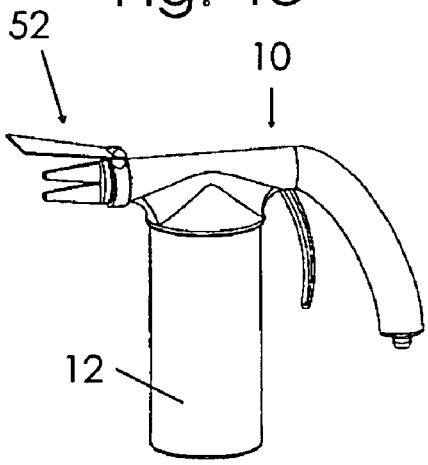
Figure 5:
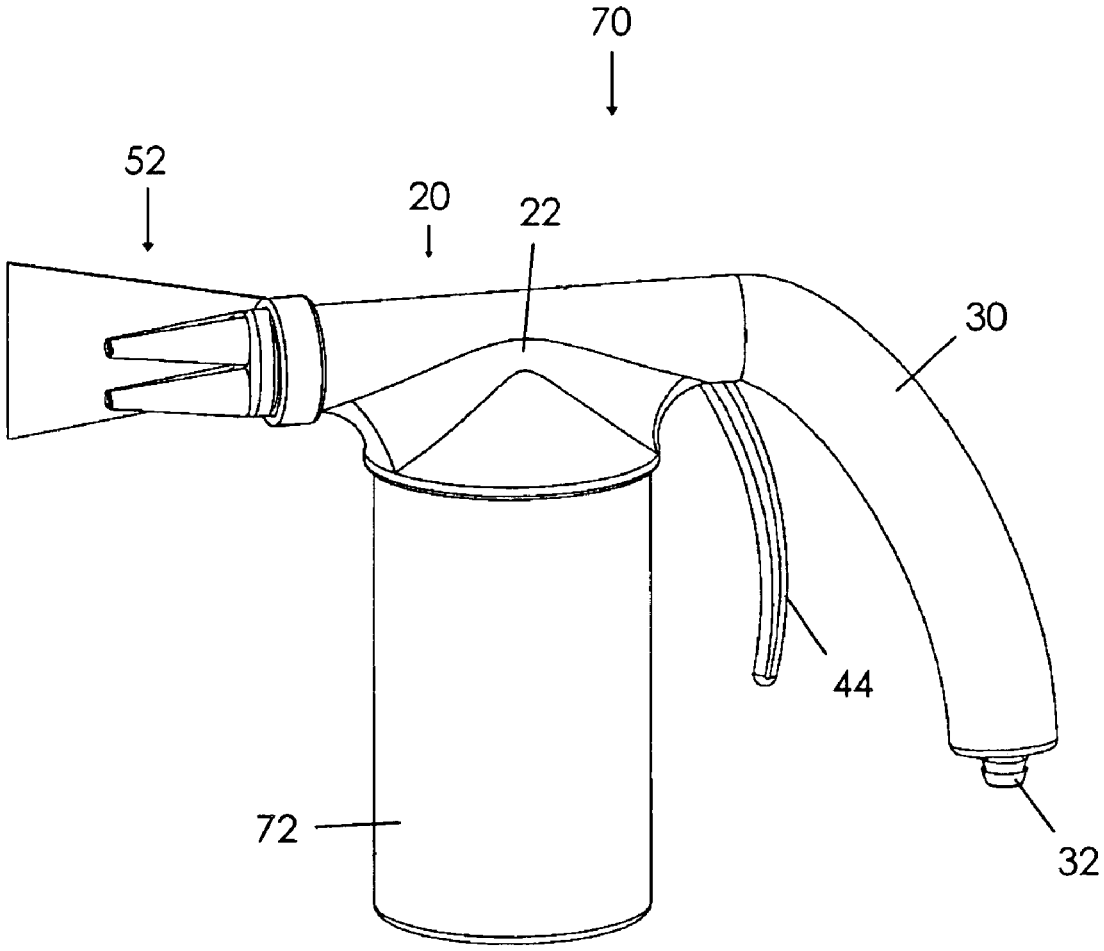
FIG. 5 is a perspective view of an apparatus for stripping paint according to another embodiment of the present invention.
Figure 6A:
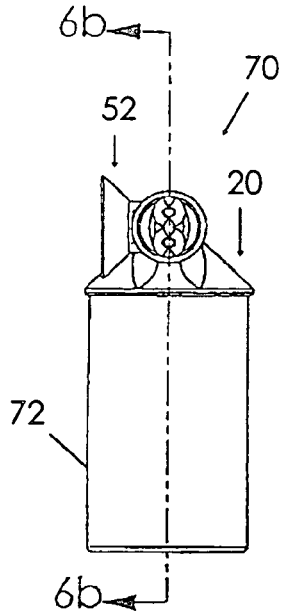
FIG. 6*a* is a front view of the apparatus as in FIG. 5.
Figure 6B:
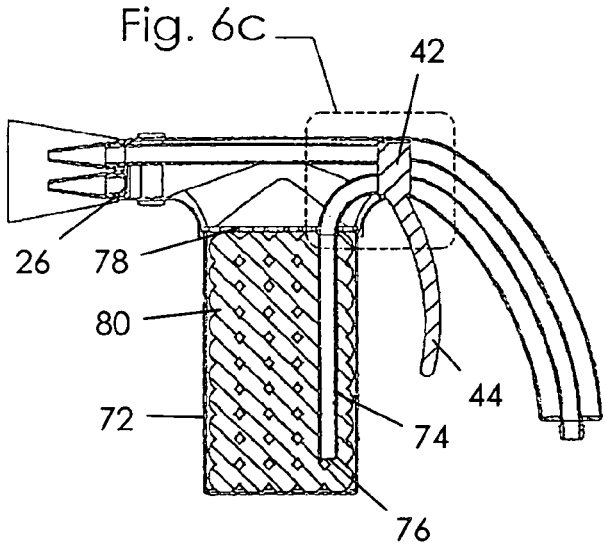
FIG. 6*b* is a sectional view taken along line 6*b*—6*b* of FIG. 6*a*, shown when the trigger is at a first configuration.
Figure 6C:
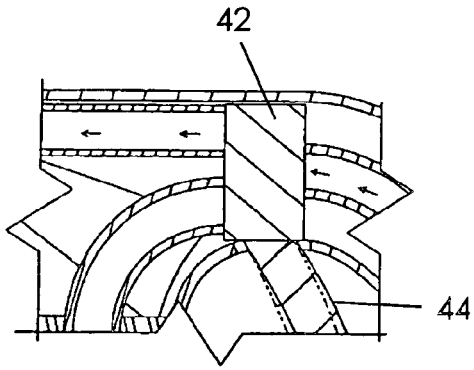
FIG. 6*c* is a sectional view taken from FIG. 6*b*, shown when the trigger is at a second configuration and shown with hidden lines depicting the trigger at the first configuration.
Figure 6D:
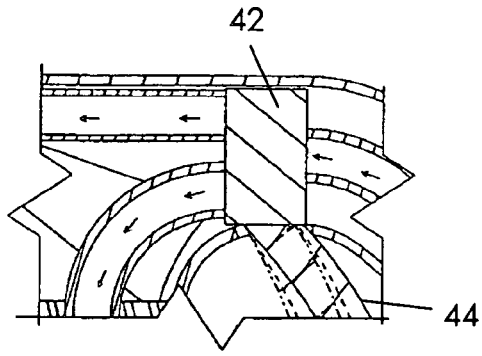
FIG. 6*d* is a sectional view as in FIG. 6*c*, shown when the trigger is at a third configuration and shown with hidden lines depicting the trigger at the first and second configurations.
Figure 7:
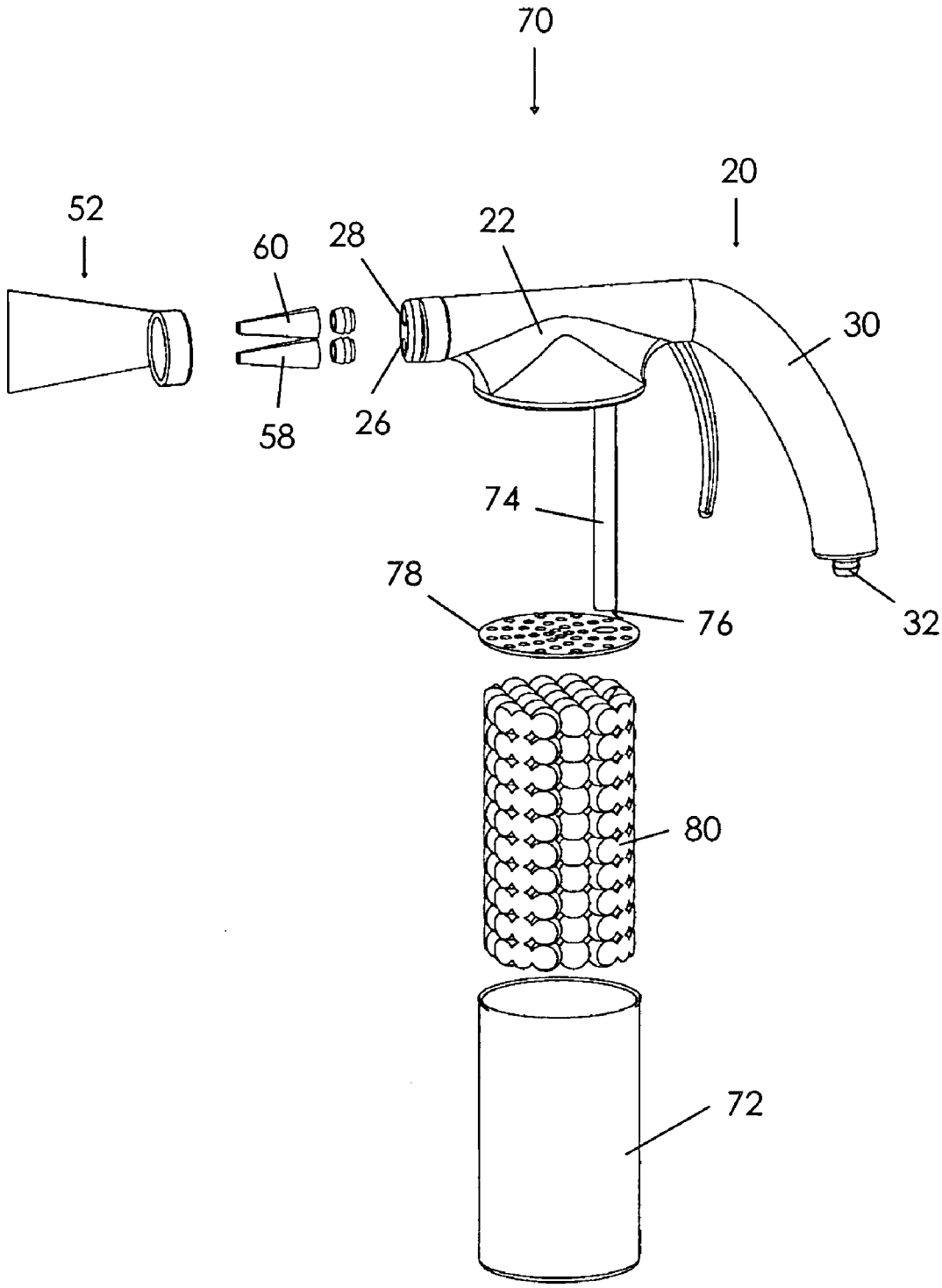
FIG. 7 is an exploded view of the apparatus as in FIG. 5.
Figure 8A:
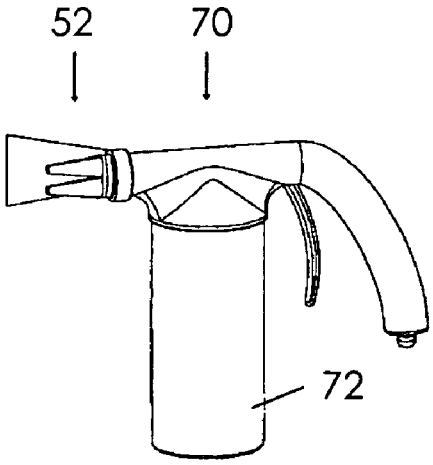
FIGS. 8*a*–8*d* are perspective views of the apparatus as in FIG. 5 showing a scraping blade in various configurations.
Figure 8B:
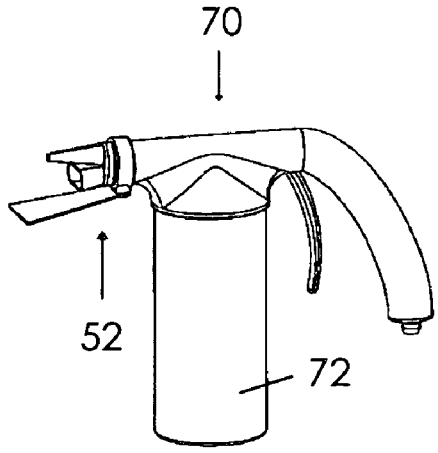
Figure 8C:
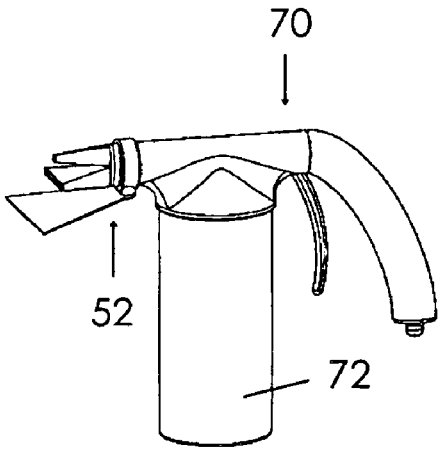
Figure 8D:
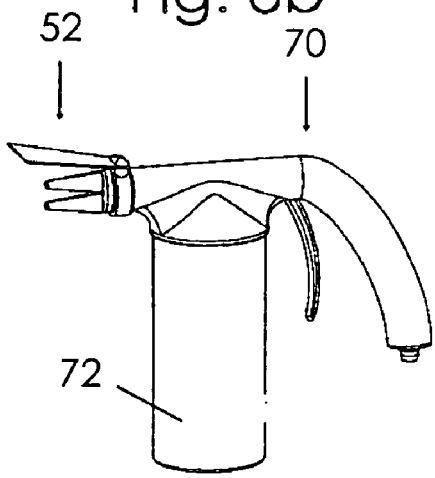

The paint stripping apparatus 10 further includes first 58 and second 60 nozzles removably coupled to the first 26 and second 28 outlet ports, respectively (FIG. 3). These nozzles may be threadably coupled, friction fitted, or any other suitable attachment means for easy removal. Thus, nozzles having desired configurations may be used depending on the type or amount of paint being removed and the pattern or form of coolant stream desired. The use of nozzles having different configurations is illustrated in FIGS. 4*b* and 4*c*.

In use, a user may connect the air inlet port 32 to a source of compressed air such as an air compressor or pressurized air tank. Making sure the housing 20 is properly mounted atop an appropriate aerosol canister 12 containing a coolant, the user may aim the first 26 and second 28 outlet ports toward a paint surface to be stripped and selectively pull the trigger 44. A short pull of the trigger 44 places the primary valve 42 in the second configuration and actuates a coolant stream to burst out of the canister actuator valve 16 and be delivered through the first outlet port 26 for contact with the paint surface. Evaporation of the propellant applies a thermal shock to the paint surface and weakens or cracks the paint. A further pull of the trigger 44 places the primary valve 42 at the third configuration and opens the air channel 36 to deliver the compressed air stream through the second outlet port 28. This high velocity of air should be sufficient to strip the weakened paint from the paint surface. Additionally, the scraping blade assembly 52 may be utilized to further strip the weakened paint.

A paint stripping apparatus 70 according to another embodiment of the invention is shown in FIGS. 5 through 8*d* and includes a construction substantially similar to the construction described previously except as specifically noted below. In this embodiment of the apparatus 70, the canister is in the form of a heat exchanger 72 such that the coolant may undergo a phase change from a solid into gaseous form for delivery to the first outlet port 26. More particularly, the preferred coolant in this embodiment is solid carbon dioxide ($CO_2$) pellets 80, commonly referred to as dry ice. Carbon dioxide is in the form of a solid when cooled to −109° F. but changes phases into a gaseous state above that temperature. Therefore, dry ice provides a dramatic coolant as it changes phases from a solid to gaseous state.

An air hose 74 extends from the primary valve 42 into the heat exchanger 72 and includes an open end 76 adjacent to the base of the heat exchanger 72 (FIG. 6). In this embodiment, activating the trigger 44 to situate the primary valve 42 to actuate a coolant stream diverts air from the air channel 36 through the air hose 74 and into the heat exchanger 72. Introduction of warmer air into the heat exchanger 72 causes the solid carbon dioxide pellets 80 to undergo a phase change via convection. The $CO_2$ gas flows upwardly through the solid $CO_2$ pellets so as to build up pressure within the heat exchanger 72 and produces a very cold stream of air. It is understood that the body portion 22 is sealed about the top of the heat exchanger 72 such that gaseous $CO_2$ may only escape through the first outlet port 26. The top of the heat exchanger 72 is open with a screen 78, perforated plate, or the like spanning the opening. The screen 78 permits the gaseous $CO_2$ to pass through while preventing any $CO_2$ solid particles from passing through that would clog up the first outlet port 26. Thus, a pressurized cold stream is exhausted for thermally shocking a painted surface. An independent compressed air stream can also be conveyed as described previously for further stripping the thermally compromised paint.

It is understood that while certain forms of this invention have been illustrated and described, it is not limited thereto except insofar as such limitations are included in the following claims and allowable functional equivalents thereof.

What is claimed is:

1. An apparatus for removing paint from a surface, comprising:

a canister at least partially containing a coolant under high pressure;

a housing mounted atop said canister and having proximal and distal ends, said proximal end having an air inlet port and said distal end having first and second outlet ports;

a trigger mounted in said housing and extending therefrom for movement between first, second, and third configurations;

a coolant channel extending between said canister and said first outlet port;

an air channel extending between said air inlet port and said second outlet port;

air delivering means cooperating with said trigger for delivering a compressed air stream through said air channel to said second outlet port when said trigger is at said second configuration; and actuating means cooperating with said trigger for actuating said canister to deliver a portion of said coolant through said coolant channel to said first outlet port when said trigger is at said third configuration.

2. The apparatus as in claim 1 wherein said actuating means includes a primary valve positioned in said housing and operatively coupled to said trigger, said actuating means including an actuator arm having a proximal end coupled to said primary valve and a distal end adjacent an actuator valve situated atop said canister for depressing said actuator valve when said trigger is at said second configuration, whereby said coolant portion is delivered through said coolant channel.

3. The apparatus as in claim 1 wherein said actuating means includes a primary valve positioned in said housing and operatively coupled to said trigger for directing said compressed air stream from said air channel against an actuator valve on a top of said canister when said trigger is at said second configuration, whereby said coolant portion is delivered through said coolant channel.

4. The apparatus as in claim 1 wherein said air delivering means includes a primary valve positioned in said housing and operatively coupled to said trigger, said primary valve being connected to said air channel for allowing said compressed air stream to flow through said air channel when said trigger is at said third configuration.

5. The apparatus as in claim 1 further comprising first and second outlet nozzles removably coupled to first and second outlet ports, respectively for directing said coolant portion and said compressed air stream.

6. The apparatus as in claim 1 further comprising a blade rotatably connected to said distal end of said housing for scraping paint from a surface.

7. The apparatus as in claim 6 wherein said blade is removably coupled to said distal end of said housing.

8. The apparatus as in claim 1 wherein:

said canister is a heat exchanger; and said coolant is solid carbon dioxide.

9. The apparatus as in claim 8 wherein said actuating means includes:

a primary valve positioned in said housing and coupled to said trigger, said primary valve being operatively connected to said air channel;

an air hose connected to said primary valve and extending into said heat exchanger, said air hose having an open end adjacent a bottom of said heat exchanger for directing said compressed air stream into said heat exchanger.

10. The apparatus as in claim 9 wherein said housing is sealed against a top of said heat exchanger in an airtight relationship.

11. The apparatus as in claim 9 wherein said heat exchanger defines an open top and includes a screen covering said open top for allowing gaseous carbon dioxide to be directed through said first outlet port when said trigger is at said second configuration and preventing passage of solid carbon dioxide particles, wherein said compressed air stream flowing into said heat exchanger causes a portion of said solid carbon dioxide to be converted into gaseous carbon dioxide.

12. An apparatus for removing paint from a surface, comprising:

a canister at least partially containing a pressurized coolant;

a housing having a body portion and a handle, said body portion defining first and second outlet ports and said handle defining an inlet port capable of receiving a compressed air stream, said body portion being removably coupled to a top of said canister;

a coolant channel extending between said canister top and said first outlet port for selectively communicating said coolant therebetween;

an air channel extending between said inlet port and said second outlet port for selectively communicating a compressed air stream therebetween;

a primary valve positioned in said body portion of said housing in communication with said coolant and air channels and selectively movable between a first configuration closing said coolant channel and said air channel, a second configuration enabling said coolant to flow through said coolant channel, and a third configuration enabling the compressed air stream to flow through said air channel;

a trigger coupled to said primary valve for user movement of said primary valve between said first, second, and third configurations; and wherein said primary valve is configured to divert the compressed air stream against an actuator valve atop said top of said canister when said primary valve is at said second configuration, whereby to deliver a portion of said coolant into said coolant channel.

13. The apparatus as in claim 12 further comprising an actuator arm having a proximal end coupled to said trigger and a distal end adjacent an actuator valve atop said canister, said distal end of said actuator arm depressing said actuator valve to release a portion of said coolant into said coolant channel when said trigger is moved so as to position said primary valve at said second configuration.

14. The apparatus as in claim 12 wherein:

said canister is a heat exchanger; and said coolant is solid carbon dioxide.

15. The apparatus as in claim 14 further comprising an air hose connected to said air channel and extending into said heat exchanger, said air hose having an open end adjacent a bottom of said heat exchanger for directing the compressed air stream upon the solid carbon dioxide.

16. The apparatus as in claim 14 wherein said heat exchanger defines an open top and includes a filter covering said open top for allowing gaseous carbon dioxide to be directed through said first outlet port when said trigger is at said second configuration and preventing passage of solid carbon dioxide particles, wherein said compressed air stream flowing into said heat exchanger causes a portion of said solid carbon dioxide to be converted into gaseous carbon dioxide.

17. An apparatus removing paint from a surface, comprising:

a canister at least partially containing a pressurized coolant;

a housing having a body portion and a handle, said body portion defining first and second outlet ports and said handle defining an inlet port capable of receiving a compressed air stream, said body portion being removably coupled to a top of said canister;

a coolant channel extending between said canister top and said first outlet port for selectively communicating said coolant therebetween;

an air channel extending between said inlet port and said second outlet port for selectively communication a compressed air stream therebetween;

a primary valve positioned in said body portion of said housing in communication with said coolant and air channels and selectively movable between a first configuration closing said coolant channel and said air channel, a second configuration enabling said coolant to flow through said coolant channel and a third configuration enabling the compressed air stream to flow through said air channel; and a blade rotatably coupled to said body portion of said housing adjacent said first and second outlet ports.

18. The apparatus as in claim 17 further comprising first and second nozzles removably coupled to first and second outlet ports, respectively.

* * * * *